US007770730B2

(12) United States Patent
Booker et al.

(10) Patent No.: US 7,770,730 B2
(45) Date of Patent: Aug. 10, 2010

(54) MICROPIPETTE HOLDER

(75) Inventors: Robert Booker, Vandergrift, PA (US); Dustin John Arabia, New Kensington, PA (US); Christopher Nick Magalich, Avonmore, PA (US)

(73) Assignee: Cook Vascular Incorporated, Leechburg, PA (US)

( * ) Notice: Subject to any disclaimer, the term of this patent is extended or adjusted under 35 U.S.C. 154(b) by 780 days.

(21) Appl. No.: 11/188,509

(22) Filed: Jul. 25, 2005

(65) Prior Publication Data

US 2006/0032773 A1 Feb. 16, 2006

Related U.S. Application Data

(60) Provisional application No. 60/592,308, filed on Jul. 29, 2004.

(51) Int. Cl.
*B65D 85/20* (2006.01)
*B65D 25/10* (2006.01)
*B65D 85/24* (2006.01)

(52) U.S. Cl. ..... 206/477; 206/470; 206/365

(58) Field of Classification Search ..... 206/477, 206/364, 478, 480, 482, 380, 365, 443, 5.1, 206/470, 336, 305, 446, 571; 220/826, 839, 220/836; 211/60.1, 69.9, 69, 68; 422/104; 248/316.7, 316.1
See application file for complete search history.

(56) References Cited

U.S. PATENT DOCUMENTS

| | | | | | |
|---|---|---|---|---|---|
| 3,489,268 | A * | 1/1970 | Meierhoefer | ..... | 206/366 |
| 5,133,454 | A * | 7/1992 | Hammer | ..... | 206/364 |
| 5,417,926 | A * | 5/1995 | Bouveret | ..... | 422/104 |
| 5,586,653 | A * | 12/1996 | Taveroff | ..... | 206/362 |
| 6,193,932 | B1 * | 2/2001 | Wu et al. | ..... | 422/28 |

FOREIGN PATENT DOCUMENTS

| | | |
|---|---|---|
| EP | 0 281 255 A1 | 9/1988 |
| EP | 0 633 192 A2 | 1/1995 |
| EP | 0 790 063 A1 | 8/1997 |

* cited by examiner

*Primary Examiner*—Mickey Yu
*Assistant Examiner*—Steven A. Reynolds
(74) *Attorney, Agent, or Firm*—Brinks Hofer Gilson & Lione

(57) ABSTRACT

A device for support and protection of a tubular element has a single-piece construction, and respective open and closed configurations. The device includes a base portion, at least one side-portion, and a living hinge interconnecting the side-portion and the base portion. The base portion includes a plurality of recesses on a surface, each recess being delimited by a plurality of pins, each pin having an indentation. The plurality of indentations form a pocket by which the tubular element is held. The living hinge opens such that the side-portion is substantially parallel to the base portion in the open configuration, and closes such that the side-portion fauns a protective shell about the base portion in the closed configuration.

9 Claims, 5 Drawing Sheets

MICROPIPETTE HOLDER

RELATED APPLICATION

The present patent document claims the benefit of the filing date under 35 U.S.C. §119(e) of Provisional U.S. Patent Application Ser. No. 60/592,308, filed Jul. 29, 2004, which is hereby incorporated by reference.

BACKGROUND

1. Technical Field

This invention relates to a protective packaging, and more particularly to a protective packaging for transport and storage of a tubular element including, but not limited to, a capillary tube or a micropipette.

2. Background Information

In general, capillary tubes are very fragile thin tubes of very small diameter made from a brittle material such as glass for example. Typically, extreme caution is needed to transport, store, grip and use capillary tubes due to their fragility, which is due to, at least in part, the nominal dimensions of the device. For example, the ratio of the external diameter of the capillary tube to its length can be on the order of 100 or more. Indeed, capillary tubes having an external diameter of about 1 mm or less and a length of about 10 cm or more are commonplace.

Micropipettes are one non-limiting example of a medical device whose nominal dimensions substantially correspond to those described above. Referring to FIG. 5, a micropipette 5 typically comprises a main portion 6 of constant diameter and a tapered portion 7 that ends in a tip. The tapered portion provides an extension in which its internal diameter is reduced to a value of about 5 to about 30 microns. Thus, the internal diameter of the tapered portion and tip are approximately a dimension of 10,000 times less than that of the length of the tube and to the order of 200 relative to its external diameter in the main portion of the micropipette. Micropipettes are particularly useful for in vitro fertilization techniques such as intracytoplasmic sperm injection (ICSI). During this procedure, a spermatozoon is picked-up using the tip of the micropipette. The micropipette tip is then used to puncture the zona pellucida and vitelline membrane to inject the sperm into the oocyte cytoplasm. The tip of the micropipette ensures that the device is as non-traumatic to the reproductive tissues as possible. A separate micropipette also may be used to retain the oocyte into which the first micropipette delivers the sperm.

From the foregoing, it can be appreciated that such tubular elements require the greatest care continuously, not only during the operations associated with their use, but also during their transport and storage. For these reasons, a packaging device that provides support and protects the tubular element against shock and flexure, even the slightest of which would unmendably break it, which is easy to grasp and to move by the user, easy to use when the tubular element is positioned therein or withdrawn therefrom, inexpensive to manufacture and, finally, small in size is needed.

BRIEF SUMMARY

In one aspect, the invention is a device for support and protection of a tubular element having a single-piece construction, an open configuration and a closed configuration, comprising: a base portion, a side-portion and at least one living hinge interconnecting the side-portion to the base portion. The base portion comprises a plurality of recesses on a surface, each recess being delimited by a plurality of pins, each pin having an indentation. The plurality of indentations form a pocket by which the tubular element is held. The at least one living hinge opens such that the side-portion is substantially parallel to the base portion in the open configuration and the at least one living hinge closes such that the side-portion forms a protective shell about the base portion in the closed configuration.

In yet another aspect, the invention is a device for support and protection of a tubular element having a single-piece construction, an open configuration and a closed configuration, comprising: a base portion, a first side-portion and a second side-portion. The first and second side-portions are interconnected to the base portion by at least one first living hinge and at least one second living hinge, respectively. The base portion comprises a plurality of recesses on a surface. The plurality of recesses is centered within the device and spaced apart from each other. Each recess is delimited by a plurality of pins and each pin has an indentation. The plurality of indentations form a pocket by which the tubular element is held. The at least one first living hinge and the at least one second living hinge open such that the first and second side-portions are substantially parallel to the base portion in the open configuration and the at least one first living hinge and the at least one second living hinge close such that the first and second side-portions form a protective shell about the base portion in the closed configuration.

In yet another aspect, the invention is a device for support and protection of a tubular element having a single-piece construction, an open configuration and a closed configuration, comprising: a base portion, a first side-portion and a second side-portion. The first and second side-portions are interconnected to the base portion by at least one first living hinge and the at least one second living hinge, respectively. The base portion comprises on a surface an alignment pin and two recesses. The alignment pin is positioned at a rear-end of the base portion and the two recesses are centered within the device and spaced apart from each other. Each recess is delimited by a first pin and a second pin. The first pin and the second pin have a first and second indentation, respectively. Each of the first second indentations comprises a generally semi-circular configuration such that the first and second indentations form a pocket comprising a generally circular configuration by which the tubular element is held. Each of the first and second pins comprises a tapered top portion and at least one of the first and second pins is formed from an elastic material. The first side-portion comprises a first outer-edge having a first-half of a locking mechanism and the second side-portion comprises a second outer-edge having a second-half of the locking mechanism. The at least one first living hinge and the at least one second living hinge open such that the first and second side-portions are substantially parallel to the base portion in the open configuration. The at least one first living hinge and the at least one second living hinge close such that the first side-portion, the second side-portion, the first outer-edge, the second outer-edge and the base portion form a protective shell about the tubular element and the first-half of the locking mechanism engages the second-half of the locking mechanism in the closed configuration.

DETAILED DESCRIPTION OF THE DRAWINGS AND THE PRESENTLY PREFERRED EMBODIMENTS

Figure 1:
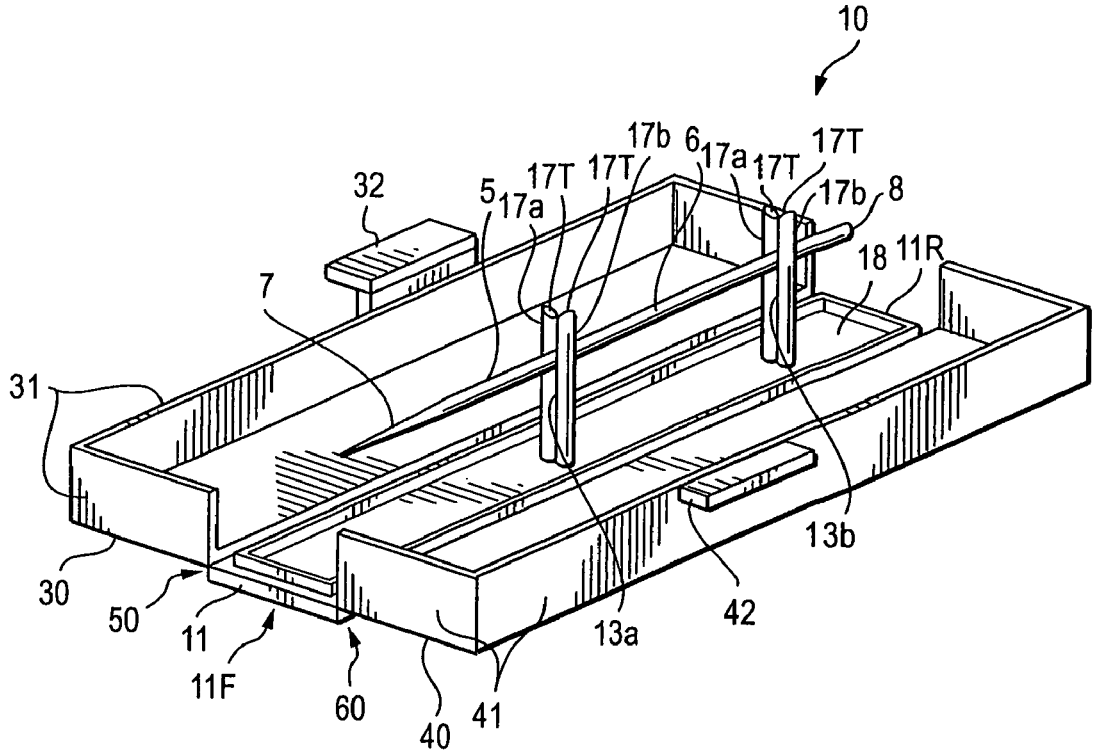
FIG. 1 is a perspective view of a device for support and protection of a tubular element in an open configuration with a tubular element supported therein according to an embodiment of the present invention.

Referring to the drawings wherein like reference numerals represent like parts throughout, reference numeral 10 is directed to a device for support and protection of a tubular element 5. The device 10 comprises a single-piece construction having an open configuration (shown in FIGS. 1-3 and 7) and a closed configuration (shown in FIGS. 4 and 8). Optionally, the single-piece construction of the device 10 is molded from plastic. The device further comprises a base portion 11, a side-portion 30 and a living hinge 50 interconnecting the base portion 11 and the side portion 30. The living hinge 50 enables the side portion 30 to be moved relative to the base portion 11. More specifically, in the open configuration, the living hinge 50 is open such that the side-portion 30 is substantially parallel to the base portion 11, as shown in FIGS. 1-3 and 7, and in the closed configuration, the living hinge 50 is closed such that the side portion 30 forms a protective shell about the base portion, as shown in FIGS. 4 and 8.

Figure 2:
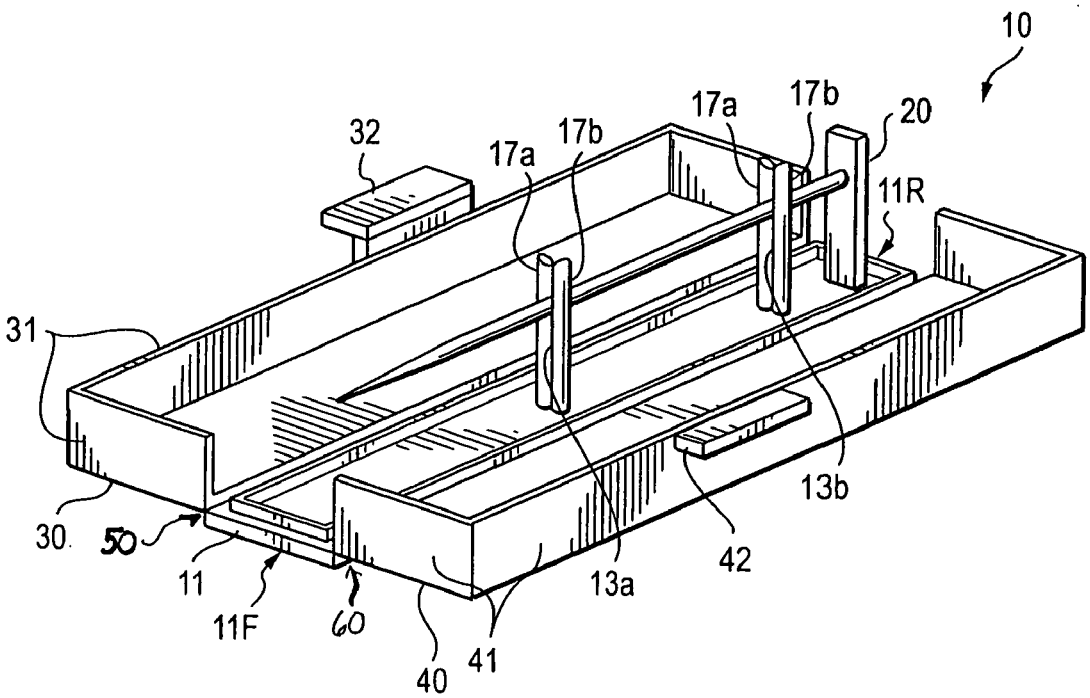
FIG. 2 is a perspective view of a device for support and protection of a tubular element in an open configuration with a tubular element supported therein according to an alternate embodiment of the present invention.
Figure 3:
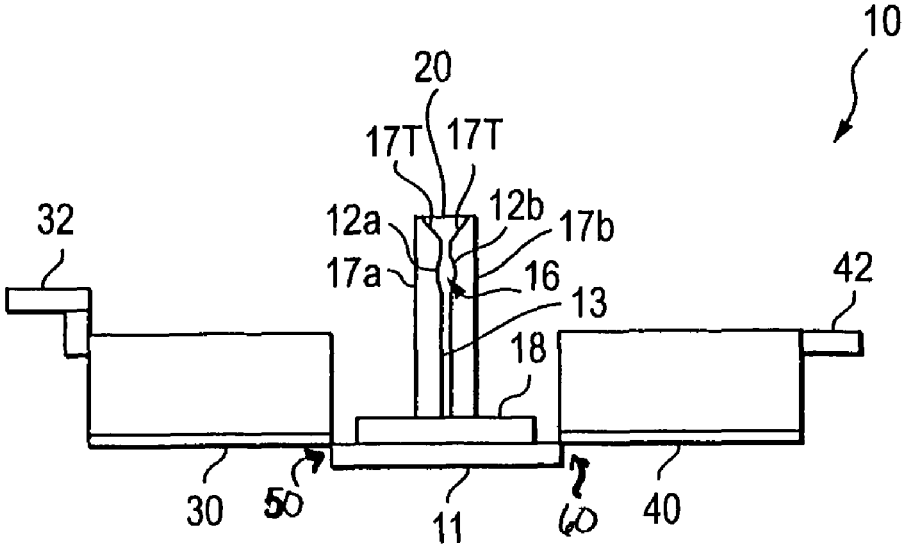
FIG. 3 is an end view of the device of FIG. 2.
Figure 4:
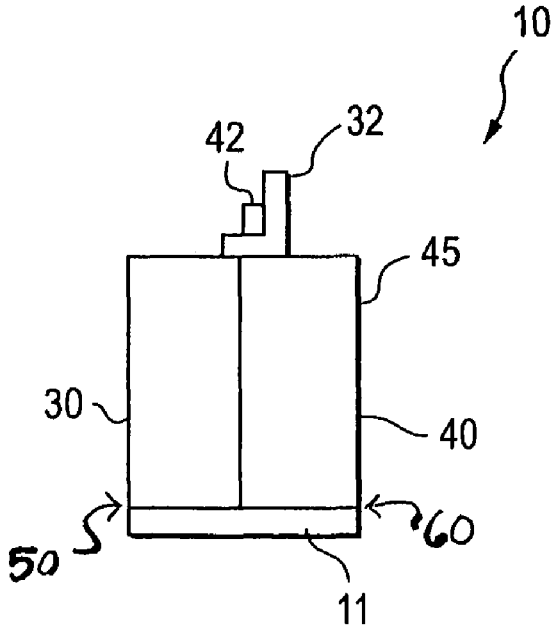
FIG. 4 is an end view of the device of FIG. 2 in a closed configuration.
Figure 5:
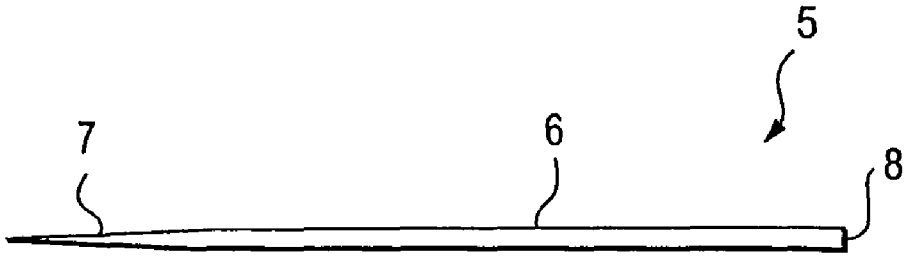
FIG. 5 is a perspective view of the tubular element of FIGS. 1 and 2, the tubular element having a tapered portion and a main portion of constant nominal diameter.

Optionally, as shown in the embodiment of FIGS. 1-4, the device 10 further includes a second side-portion 40 and a second living hinge 60 interconnecting the base portion 11 and the second side-portion 40. Living hinge 60 enables the second side-portion 40 to be moved relative to the base portion 11. More specifically, in the open configuration, the living hinge 60 is open such that the second side-portion 40 is substantially parallel to the base portion 11, as shown in FIGS. 1-3 and 7, and, in the closed configuration, the living hinge 60 is closed such that the second side-portion 40 forms a protective shell about the base portion, as shown in FIGS. 4 and 8.

The base portion 11 comprises a plurality of recesses 13. By way of a non-limiting example, the base portion 11 comprises a first and a second recess 13*a*, 13*b*, respectively, on an interior surface 18. Optionally, the plurality of recesses are centered within the device but spaced apart from each other. Each recess 13 is delimited by a plurality of pins 17. Each pin 17 is perpendicular to the base portion 11 and comprises an indentation 12. The plurality of indentations 12 associated with each recess forms a pocket 16 by which the tubular element 5 is held as best seen in FIGS. 9B-C. At least one of the plurality of pins is flexible to allow for the insertion and removal of the tubular element 5 while still returning to its original orientation. Optionally, each pin 17 comprises a tapered top-portion 17T to facilitate the insertion and the removal of the tubular element 5.

Turning to the embodiment shown in FIGS. 1-3, each recess 13*a*, 13*b* is delimited by a first pin 17*a* having a first indentation 12*a* and a second pin 17*b* having a second indentation 12*b*. The first and second indentations 12*a*, 12*b* each comprise a semi-circular configuration to form a pocket 16 having a generally circular configuration.

Alternatively, each recess 13 can be delimited by a greater number of pins. For example, in the embodiment of FIG. 7, each recess 13*a*, 13*b* is delimited by a first pin 17*a*, a second pin 17*b* and a third pin 17*c*. The first, second and third indentations 12*a*, 12*b*, 12*c* associated with each recess 13*a*, 13*b* each comprise a semi-circular configuration to form a pocket 16 having a generally circular configuration.

It is believed that a pocket 16 having a generally circular configuration distributes the stress imparted by the pins 17 to the tubular element 5 evenly along the generally circular contour of the tubular element 5. For this reason, a pocket 16 having a generally circular configuration imparts the least amount of stress to the tubular element also having a generally circular contour held therein. However, any other suitable configuration can be used for the indentation including grooves, notches or other various shapes.

Figure 9A:
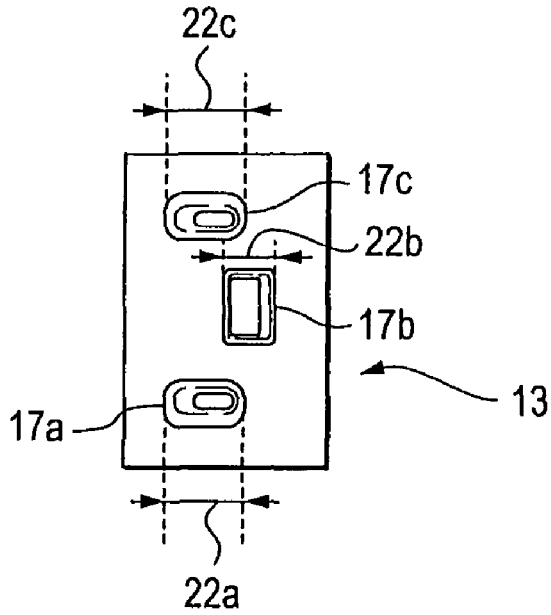
FIG. 9A is a top view of a recess formed from three pins according to one embodiment of the present invention.
Figure 9B:
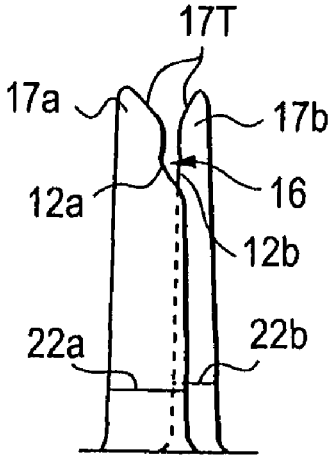
FIG. 9B is an end view of the recess and pin configuration of FIG. 9A.
Figure 9C:
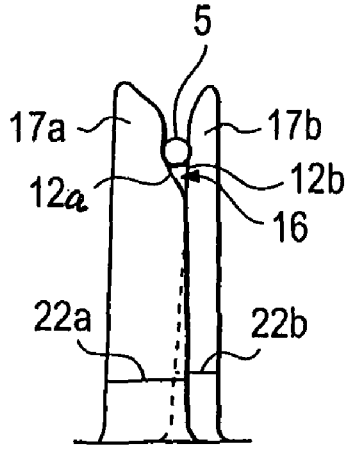
FIG. 9C is an end view of the recess and pin configuration of FIG. 9A retaining a tubular element.

Each pin 17 can be uniform in size and thickness, as shown in FIG. 1-3, or the thickness of the pins can vary as shown in FIGS. 9A-C. Optionally, the thickness of the pins can also taper from the base of the pin to the top of the pin, as shown in FIGS. 9B and 9C. By altering the thickness of the pins, the flexibility of the pins can be varied. In general, reducing the thickness of the pin increases the flexibility of the pin. As the flexibility of the pin increases, the ease in which the tubular member can be inserted and removed from the recess also increases. Turning to FIGS. 9A-9C, there is shown a top view and an end view of a recess formed from three pins 17*a*, 17*b* and 17*c*. In this embodiment, the thickness 22*b* of the center pin 17*b* is less than the thickness 22*a*, 22*c* of each end pin 17*a* and 17*c*. Thus, the center pin 17*b* is more flexible than the end pins 17*a* and 17*c*. In addition, the thickness 22 of the pins 17 decreases from the base of the pin to the top of the pin. Thus, each pin is more flexible towards the top of the pin than the base of the pin.

Optionally, as shown in FIGS. 1 and 2, the tubular element 5 is positioned within the recesses 13 such that its tapered portion 7 is directed towards a front-end base portion 11F.

Figure 7:
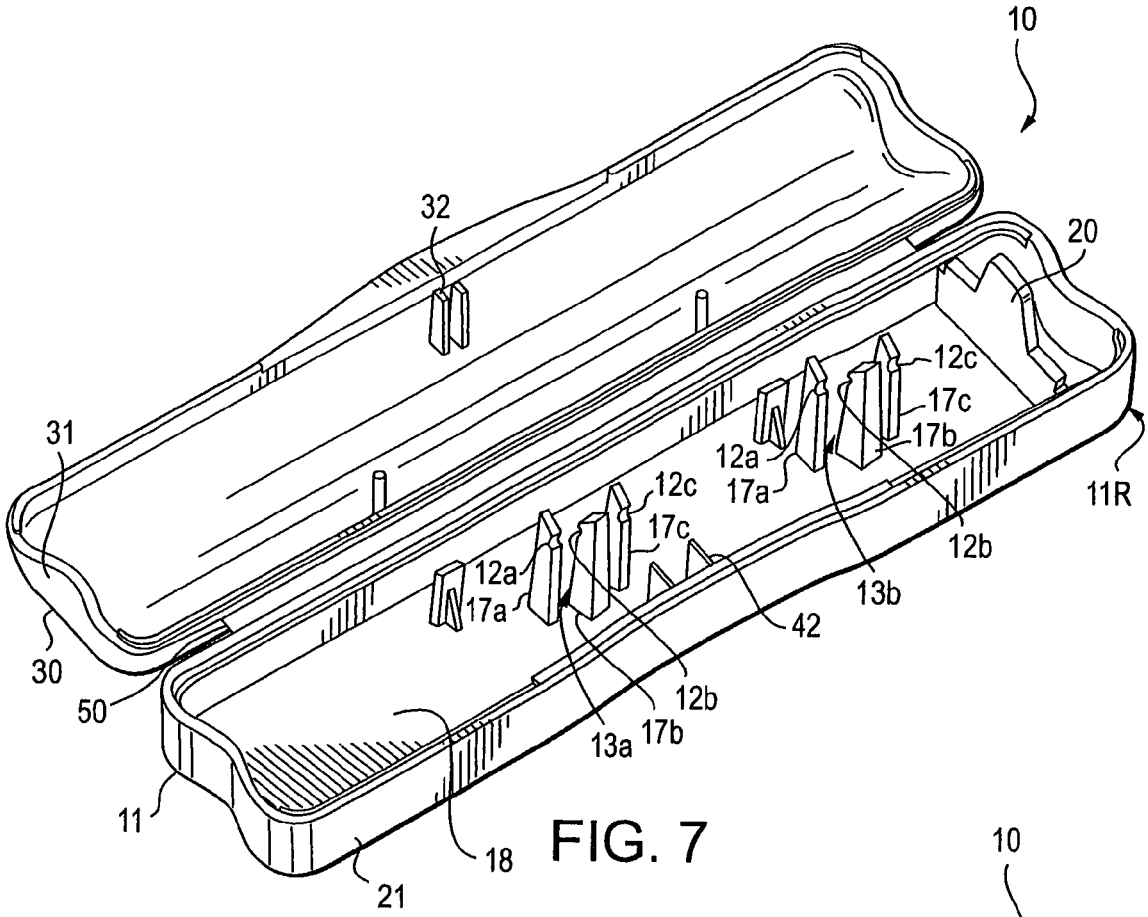
FIG. 7 is a perspective view of a device for support and protection of a tubular element in an open configuration with a tubular element supported therein according to an another alternate embodiment of the present invention.
Figure 8:
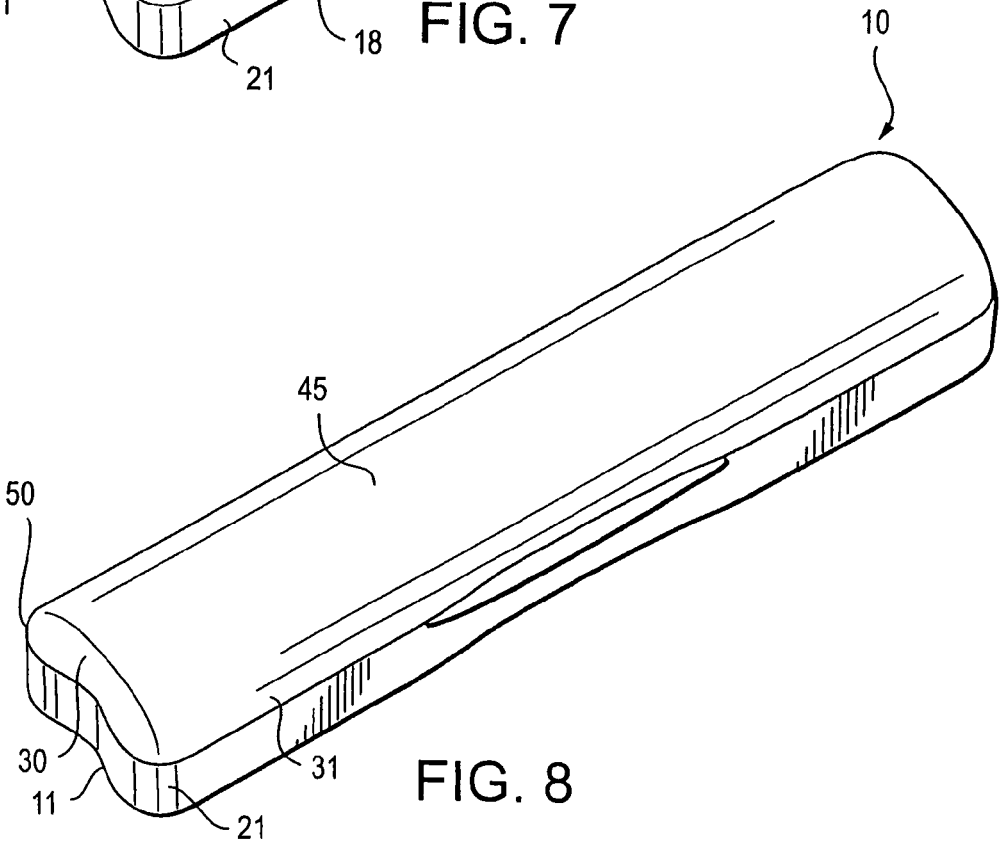
FIG. 8 is a perspective view of the device of FIG. 7 in a closed configuration.

Optionally, as best seen in FIGS. 2 and 7, the device 10 further includes an alignment structure 20 positioned at a rear end of the base portion 11R to align the tubular element 5 between the plurality of recesses. The alignment structure 20 is perpendicular to the base portion 11 as well as a proximal end 8 of the tubular element 5. The alignment structure 20 can have any suitable shape and several shapes have been contemplated for the alignment structure 20 including, but not limited to, a pin, as shown in FIG. 2, or a wall, as shown in FIG. 7.

Referring to the embodiment shown in FIGS. 1-4, the first and second side-portions 30, 40 are interconnected to the base portion 11 by the first and second living hinges 50, 60, respectively. In the open configuration, the first and second side-portions 30, 40 are substantially parallel to the base portion 11 as shown in FIGS. 1-3. In the closed configuration, the first and second side-portions 30, 40 form a protective shell 45 about the tubular element 5 as shown in FIG. 4. FIG. 4 depicts the first and second side-portions 30, 40 raised and substantially perpendicular to the base portion 11.

Optionally, the first side-portion and the second side-portion 30, 40 comprise a first outer-edge 31 and a second outer-edge 41, respectively, which together with the base portion 11 form the protective shell about the tubular element 5 in the closed configuration. Also optionally, the first and second side-portions 30, 40 are configured to form an interference fit with each other in the closed configuration, as shown in FIGS. 1-4. For example, the first side-portion 30 comprises a first-half of a locking mechanism 32 and the second side-portion 40 comprises the second-half of the locking mechanism 42, as shown in FIGS. 1-3. The first-half of the locking mechanism 32 is capable of engaging the second-half of the locking mechanism 42 in the closed configuration, as shown in FIG. 4.

Referring to the embodiment shown in FIG. 7, the side-portion 30 is interconnected to the base portion 11 by a single living hinge 50. In the open configuration, the side-portion 30 is substantially parallel to the base portion 11 as shown in FIG. 7. In the closed configuration, the side-portion 30 is raised and lowered about the base portion 11 such that the side-portion 30 and the base portion 11 form a protective shell 45 about the tubular element, as shown in FIG. 8. FIG. 7 shows the side-portion 30 and the base portion 11 can be formed with a side outer-edge 31 and a base outer-edge 21, respectively.

Optionally, the side-portion 30 and the base portion 11 are configured to form an interference fit with each other. For example, FIG. 7 shows one possible arrangement wherein an interior surface of the side-portion 30 comprises a first-half locking mechanism 32 and an interior surface of the base portion 11 comprises a second-half locking mechanism 42. Those skilled in the art will appreciate that other known elements can also be arranged to form an interference fit, and locking mechanisms 32, 42 are merely examples of numerous other possible arrangements which are considered within the scope of the invention.

Although, the figures depict the protective shell 45 to be rectangular in contour, the protective shell 45 can have any suitable contour. For example, if the side-portions 30, 40 and the base portion 11 were elliptical rather than rectangular, then the protective shell 45 would be elliptical in contour in the closed configuration.

The first and second living hinges 50, 60 comprise thin sections of material, such as plastic, that connect the first and second side-portions 30, 40 with the base portion 11, respectively. The first living hinge 50 keeps the first side-portion 30 together with the base portion 11 and allows the first side-portion 30 to be moved relative to the base portion 11. Likewise, the second living hinge 60 keeps the second side-portion 40 together with the base portion 11 and allows the second side-portion 40 to be moved relative to the base portion 11. The materials used to make a living hinge are usually a very flexible plastic such as polypropylene and polyethylene. These materials can flex more than a million cycles without failure.

Figure 6:
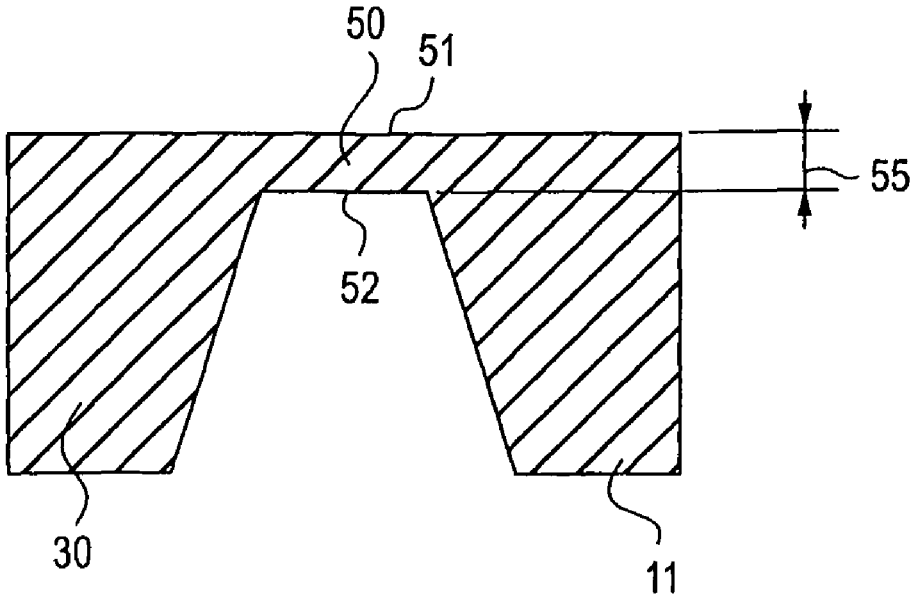
FIG. 6 is an enlarged, cross-sectional view of a living hinge of the device of FIGS. 1 and 2.

FIG. 6 shows one exemplary configuration of a living hinge 50. Since the first living hinge 50 and the second living hinge 60 are substantially the same, reference will be made to only the first living hinge 50. The living hinge 50 comprises an interior hinge surface 51, an exterior hinge surface 52 and a living hinge thickness 55. The living hinge thickness 55 ranges from about 0.007 in. to about 0.015 in.

Although the figures show the first side-portion 30 attached to the base portion 11, by a single first living hinge 50 extending substantially along the length the first side-portion 30, a plurality of first living hinges 50 spaced apart from each other can also be used. For example, two first living hinges 50 can be spaced apart from each other along the length of the first side-portion 30. Similarly, the second side-portion 40 can be attached to the base portion 11 by a plurality of second living hinges 60 spaced apart from each other along the length of the second side-portion 40.

It is therefore intended that the foregoing detailed description be regarded as illustrative rather than limiting, and that it be understood that it is the following claims, including all equivalents, that are intended to define the spirit and scope of this invention.

The invention claimed is:

1. A device for support and protection of a micropipette, said device having a single-piece construction, an open configuration and a closed configuration, comprising:

a base portion having a front portion, a rear portion, a length and having respective first and second edges along said base portion length, a first side-portion having a length and having an edge along said first side-portion length, and at least one first living hinge interconnecting the first side-portion edge and the first base portion edge; a second side-portion having a length and having an edge along said second side-portion length, and at least one second living hinge interconnecting the second side-portion edge and the second base portion edge; the base portion comprising a plurality of recesses on a surface, each recess being delimited by a plurality of pins, each pin having an indentation, the plurality of indentations forming a pocket suitable for supporting and protecting the micropipette, the plurality of recesses being centered in the device and spaced apart from each other along said base portion length, and further comprising an alignment structure spaced from said rear portion and configured for engagement with said micropipette, for aligning the micropipette between the plurality of recesses;

wherein the at least one first living hinge and the at least one second living hinge open such that the respective first and second side-portions are substantially parallel to the base portion in the open configuration;

wherein the at least one first hinge and the at least one second hinge close such that the respective first and second side-portions form a protective shell about the base portion in the closed configuration; and wherein the first and second side-portions are substantially perpendicular to the base portion in the closed configuration.

2. The device of claim 1, wherein the first side-portion and the second side-portion are configured to form an interference fit with each other in the closed configuration.

3. The device of claim 1, wherein the first side-portion comprises a first-half of a locking mechanism and the second side-portion comprises a second-half of the locking mechanism, the first-half locking mechanism being capable of engaging the second-half of the locking mechanism in the closed configuration.

4. An assembly comprising:

a micropipette; and a device for support and protection of the micropipette, the device having a single-piece construction, an open configuration and a closed configuration, comprising:

a base portion, a first side-portion and a second side-portion; the first and second side-portions being interconnected to the base portion by at least one first and at least one second living hinge, respectively; the base portion comprising a plurality of recesses on a surface, the plurality of recesses being centered within the device and spaced apart from each other, each recess being delimited by a plurality of pins, each pin having an indentation, the plurality of indentations forming a pocket by which the micropipette is held;

wherein the at least one first and at least one second living hinges open such that the first and second side-portions are substantially parallel to the base portion in the open configuration;

wherein the at least one first and at least one second living hinges close such that the first and second side-portions and the base portion form a protective shell about the micropipette in the closed configuration; and wherein the first and second side-portions are substantially perpendicular to the base portion in the closed configuration.

5. The assembly of claim 4, wherein the first and second side-portions are configured to form an interference fit with each other in the closed configuration.

6. The assembly of claim 4, wherein the first side-portion comprises a first-half of a locking mechanism and the second side-portion comprises a second-half of the locking mechanism, the first-half locking mechanism being capable of engaging the second-half of the locking mechanism in the closed configuration.

7. The assembly of claim 4, wherein the first side-portion comprises a first outer-edge and the second side-portion comprises a second outer-edge, wherein the first side-portion, the second side-portion, the first outer-edge, the second outer-edge and the base portion are configured to form a box about the micropipette in the closed configuration.

8. The assembly of claim 4, wherein each pin comprises a tapered top-portion and at least one pin is formed from an elastic material, and wherein the first side-portion and the second side-portion are configured to form an interference fit with each other in the closed configuration.

9. The assembly of claim 4, wherein said base portion comprises a front portion and a rear portion, further comprising an alignment structure spaced from said rear portion and structured for engagement with said micropipette for aligning the micropipette between the plurality of recesses.

* * * * *